US011688332B2

(12) United States Patent
Richter et al.

(10) Patent No.: US 11,688,332 B2
(45) Date of Patent: Jun. 27, 2023

(54) CONTROL METHOD FOR A DISPLAY APPARATUS AND DISPLAY APPARATUS

(71) Applicant: OSRAM Opto Semiconductors GmbH, Regensburg (DE)

(72) Inventors: Daniel Richter, Bad Abbach (DE); Marcel Severin, Regensburg (DE)

(73) Assignee: OSRAM OPTO SEMICONDUCTORS GMBH, Regensburg (DE)

( * ) Notice: Subject to any disclaimer, the term of this patent is extended or adjusted under 35 U.S.C. 154(b) by 0 days.

(21) Appl. No.: 17/636,118

(22) PCT Filed: Aug. 18, 2020

(86) PCT No.: PCT/EP2020/073085
§ 371 (c)(1),
(2) Date: Feb. 17, 2022

(87) PCT Pub. No.: WO2021/032733
PCT Pub. Date: Feb. 25, 2021

(65) Prior Publication Data

US 2022/0293040 A1 Sep. 15, 2022

(30) Foreign Application Priority Data

Aug. 21, 2019 (DE) ..... 10 2019 122 474.8

(51) Int. Cl.
*G09G 3/32* (2016.01)

(52) U.S. Cl.
CPC ..... *G09G 3/32* (2013.01); *G09G 2310/08* (2013.01); *G09G 2320/0242* (2013.01); *G09G 2320/0257* (2013.01); *G09G 2330/021* (2013.01)

(58) Field of Classification Search
CPC ..... G09G 3/32; G09G 2310/08; G09G 2320/0242; G09G 2320/0257; G09G 2330/021; H05B 45/24
See application file for complete search history.

(56) References Cited

U.S. PATENT DOCUMENTS

2010/0315403 A1 12/2010 Kaneyoshi et al.
2011/0234097 A1 9/2011 Radermacher
(Continued)

FOREIGN PATENT DOCUMENTS

DE 10 2019 106 527 A1 9/2020
DE 10 2019 112 456 A1 11/2020
(Continued)

OTHER PUBLICATIONS

International Search Report issued for corresponding International Patent Application No. PCT/EP2020/073085 dated Dec. 4, 2020, along with an English translation.
(Continued)

*Primary Examiner* — Andrew Sasinowski
(74) *Attorney, Agent, or Firm* — Hauptman Ham, LLP

(57) ABSTRACT

A control method includes A) determining intrinsic activation times of individual semiconductor emitters of a display device. The display device includes a plurality of light-emitting semiconductor emitters with different intrinsic activation times. The method also includes B) determining and storing in each case an activation delay and/or a turn-on current change for each individual one of the semiconductor emitters. The method further includes C) energizing the individual semiconductor emitters according to the previously determined activation delay and/or turn-on current change, so that in a display mode of the display device the semiconductor emitters have equally long starting times for a light emission.

16 Claims, 4 Drawing Sheets

(56) References Cited

U.S. PATENT DOCUMENTS

Figure 1:
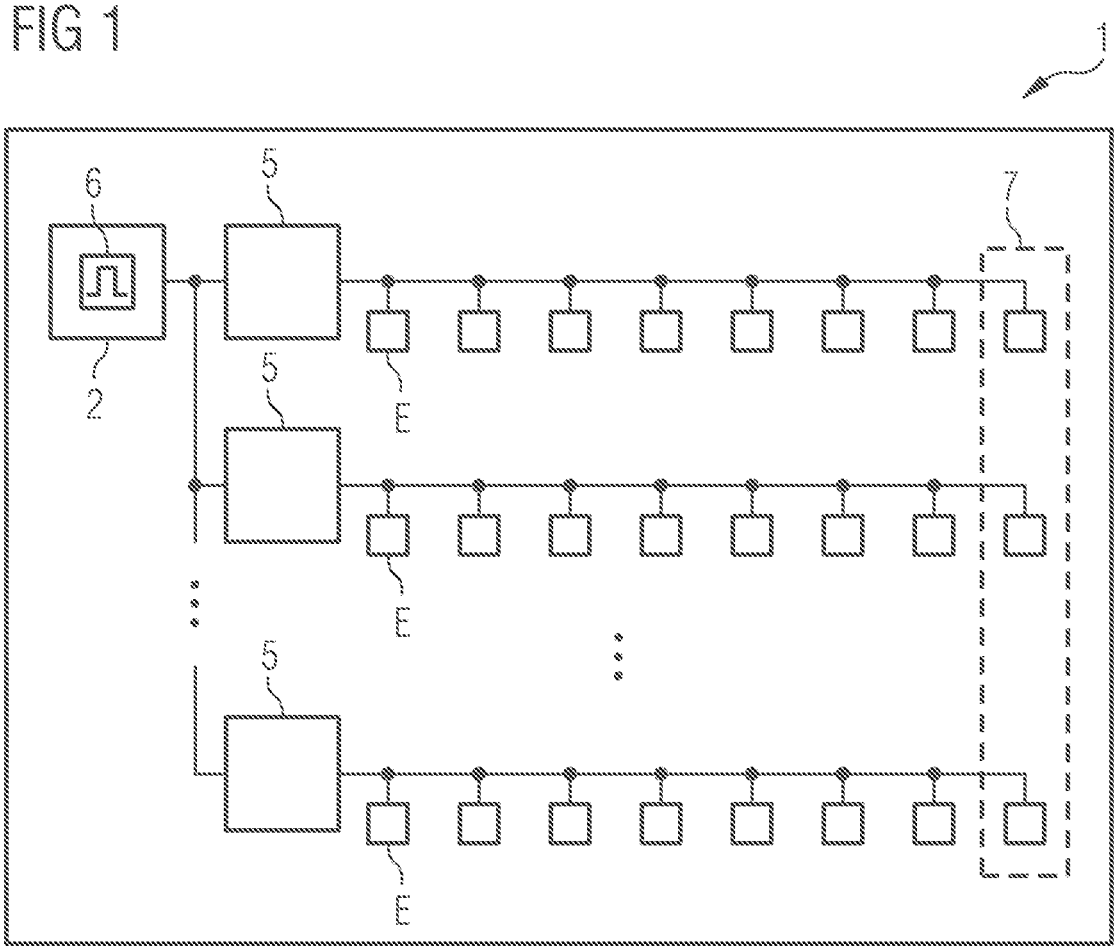

| | | | | |
|---|---|---|---|---|
| 2012/0188291 | A1 | 7/2012 | Kobayashi | |
| 2013/0300724 | A1 | 11/2013 | Chaji | |
| 2014/0139139 | A1* | 5/2014 | Li | G09G 3/32 315/297 |
| 2016/0042719 | A1* | 2/2016 | Muramatsu | G09G 3/32 345/82 |
| 2016/0119990 | A1 | 4/2016 | Williams et al. | |
| 2017/0116898 | A1 | 4/2017 | Choi et al. | |
| 2019/0088200 | A1 | 3/2019 | Woo et al. | |
| 2019/0189044 | A1 | 6/2019 | Perala et al. | |
| 2020/0143756 | A1* | 5/2020 | Chen | G09G 3/3406 |
| 2020/0202773 | A1* | 6/2020 | Genoe | G09G 3/3275 |
| 2020/0267816 | A1* | 8/2020 | Nemati | G09G 3/32 |
| 2020/0342799 | A1* | 10/2020 | Yang | H01L 27/14812 |
| 2020/0380926 | A1* | 12/2020 | Douglas | G09G 3/20 |
| 2021/0312858 | A1* | 10/2021 | Cheng | H01L 33/62 |

FOREIGN PATENT DOCUMENTS

| | | | |
|---|---|---|---|
| EP | 2 242 035 | A1 | 10/2010 |
| WO | 2018/163021 | A1 | 9/2018 |

OTHER PUBLICATIONS

Written Opinion issued for corresponding International Patent Application No. PCT/EP2020/073085 dated Dec. 4, 2020.

Chaziachmetovas, "Driver Topology Influence on LED Luminescence Response Dynamics", Electronika IR Electrotechnika, ISSN 1392-1215, vol. 20, No. 5, 2014, pp. 104-107, cited in NPL Nos. 1 and 2.

* cited by examiner

CONTROL METHOD FOR A DISPLAY APPARATUS AND DISPLAY APPARATUS

CROSS REFERENCE TO RELATED APPLICATION

This application is a National Stage of International Application No. PCT/EP2020/073085, filed on Aug. 18, 2020, which designates the United States and was published in Europe, and which claims priority to German Patent Application No. 10 2019 122 474.8, filed on Aug. 21, 2019, in the German Patent Office. Both of the aforementioned applications are hereby incorporated by reference in their entireties.

A control method is specified. In addition, a display apparatus is specified.

A problem to be solved is to specify a control method by means of which light-emitting semiconductor emitters can be activated efficiently and with a high color reproduction quality.

This object is achieved, inter alia, by a control method and by a display device having the features of the independent patent claims. Preferred developments are the subject matter of the remaining claims.

According to at least one embodiment, a plurality of light-emitting semiconductor emitters are controlled by the method. The semiconductor emitters are preferably light-emitting diode units and/or light-emitting diode chips. Each of the semiconductor emitters can thus be formed by a separate light-emitting diode chip. Alternatively, the semiconductor emitters are individual segments of light-emitting diode chips, wherein corresponding light-emitting diode chips comprise a plurality of the segments and the segments can preferably be operated electrically independently of one another.

According to at least one embodiment, the semiconductor emitters each comprise a semiconductor layer sequence. The semiconductor layer sequence has at least one active zone, which is configured to generate radiation during operation of the light-emitting diode chip. The semiconductor layer sequence is preferably based on a III-V compound semiconductor material. The semiconductor material is, for example, a nitride compound semiconductor material such as $Al_nIn_{1-n-m}Ga_mN$ or a phosphide compound semiconductor material such as $Al_nIn_{1-n-m}Ga_mP$ or also an arsenide compound semiconductor material such as $Al_nIn_{1-n-m}Ga_mAs$ or such as $Al_nGa_mIn_{1-n-m}As_kP_{1-k}$, where $0 \leq n \leq 1$, $0 \leq m \leq 1$ and $n+m \leq 1$ and $0 \leq k < 1$. The semiconductor layer sequence can have dopants and additional constituents. For the sake of simplicity, however, only the essential constituents of the crystal lattice of the semiconductor layer sequence, that is, Al, As, Ga, In, N or P, are indicated, even if they can be partially replaced and/or supplemented by small amounts of further substances.

Radiation generated in the semiconductor emitters is emitted by the semiconductor emitters, in particular emitted in such a way as produced in the associated semiconductor layer sequence. This means that there are preferably semiconductor layer sequences for generating red light, for generating green light and for generating blue light. This means that the display device for the control method can be free of phosphors. Alternatively, it is possible for semiconductor emitters for different colors to be based on the same semiconductor material system and/or on the same semiconductor layer sequence, and that an emission color is achieved by means of one or more phosphors which can be applied only locally, if required.

According to at least one embodiment, the semiconductor emitters have different intrinsic activation times, also referred to as intrinsic switching times. The intrinsic activation time is that time period from a start of an energization of the relevant semiconductor emitter up to the onset of a light emission of a specific strength of the relevant semiconductor emitter. At a predetermined voltage and/or at a predetermined current, the intrinsic activation time is an inherent property of the relevant semiconductor emitter, at least at a certain temperature, such as room temperature, that is to say 300 K.

According to at least one embodiment, the control method comprises the step of determining the intrinsic activation times of the individual semiconductor emitters. The activation times are determined, for example, by an analysis of a time profile of a voltage at the semiconductor emitter and/or a time profile of a voltage at a current source or at a voltage source for the relevant semiconductor emitter. Alternatively, the activation time can be determined by a time dependence of a light-curve of a specific semiconductor emitter.

The intrinsic activation times of the semiconductor emitters are preferably determined via an electrical, time-dependent characteristic. The intrinsic activation time is preferably determined individually for each individual semiconductor emitter.

According to at least one embodiment, the control method comprises the step of determining and/or storing an activation delay and/or a turn-on current change for each individual one of the semiconductor emitters. The activation delays are in each case time periods for which a switching process of a specific semiconductor emitter is delayed. The turn-on current changes are changes of a current during a switch-on phase of the associated semiconductor emitter.

As a result of the activation delays and/or by the turn-on current changes, the switching behavior of the relevant semiconductor emitter can be changed, so that differences in the intrinsic activation times between different semiconductor emitters can be compensated for and a light emission of the different semiconductor emitters can thus begin simultaneously or substantially simultaneously. Substantially simultaneously means, for example, a time tolerance of at most 0.1 μs or 30 ns, in particular between 10 ns and 30 ns inclusive.

According to at least one embodiment, the method comprises the step of energizing the individual semiconductor emitters according to the previously determined activation delay and/or turn-on current change. This makes it possible to achieve equally long starting times for the light emission of the semiconductor emitters in a display operation of the display device. It is possible that the determination and storage of the activation delays and/or the turn-on current changes take place before an actual intended display operation of the display device, in particular in a calibration mode.

In at least one embodiment, the control method is used to control a display device which has a plurality of light-emitting semiconductor emitters with different intrinsic activation times. The method comprises the following steps, preferably in the stated sequence:

A) determining the intrinsic activation times of the individual semiconductor emitters, B) determining and storing in each case an activation delay and/or a turn-on current change for each individual one of the semiconductor emitters, and C) energizing the individual semiconductor emitters according to the previously determined activation delay and/or turn-on current change, so that in a display mode of the display device the semiconductor emitters have equally long starting times for a light emission.

Due to the technology differences between nitride-based semiconductor emitters and phosphide-based semiconductor emitters and on account of differences in the typical chip sizes for red, green and blue-emitting semiconductor chips in display devices having many different semiconductor chips, the switching times of the individual chips differ significantly from one another. The same applies to the semiconductor chips of a specific emission color, which are nominally structurally identical, but which have tolerances in the starting times. Essentially, the activation times, also referred to as turn-on times, depend on the quotient of the capacitance C and the operating current I, or C/I. In this case, the capacitance C is in particular a function of the chip surface and of the material system, in addition to other influencing factors.

Especially at low brightnesses of the display device to be represented and at high frame repetition rates in video applications, that is to say at low operating currents, a red shift is generally observed without further measures. This is in particular due to the fact that the activation times for green and blue-emitting semiconductor chips are substantially longer than for red-emitting semiconductor chips. Due to fluctuations in the activation times within a chip batch, random fluctuations in the activation times occur, which can only be compensated for with difficulty without further measures.

With the control method described herein, an automatic semiconductor emitter-resolved compensation of the different switching times, in particular with different capacitances of the semiconductor emitters, is made possible and discretization errors can be minimized.

With the control method described herein and with the control device described herein, lower minimum brightnesses can be represented without color shifts. Manufacturing tolerances, external influences and discretization errors can thus be compensated for almost completely. In addition, higher brightnesses of the display device can be achieved.

In particular as a result of the turn-on current changes, a large part up to the entire clock time of a pulse width modulation, PWM for short, can be used for displaying image contents, since fewer and/or shorter activation delays are required. Thus, a dynamic range of the displayable brightnesses of the display device can be maximized, with color shifts being avoidable. This results in an improvement in the representation in particular of HDR images. HDR stands for High Dynamic Range.

According to at least one embodiment, the display device has one or more groups of semiconductor emitters. The following description is made for only a single group of semiconductor emitters to simplify the embodiments; however, the embodiments can be transferred to a plurality of groups of semiconductor emitters.

The, for example, only one group comprises N of the semiconductor emitters. N is, for example, at least four or at least eight or at least 16. Alternatively or additionally, N is at most 256 or at most 64 or at most 16. Alternatively, it is possible that N is a comparatively large number, for example, is at least $10^3$ and/or at most $10^{10}$.

According to at least one embodiment, the display device is controlled at a clock frequency, in particular by means of pulse width modulation. The clock frequency of the PWM is, for example, at least 15 MHz or 30 MHz and/or at most 100 MHz or 50 MHz or 35 MHz. The clock frequency is assigned a clock time, also referred to as cycle time. The clock time is the inverse of the clock frequency.

According to at least one embodiment, the individual activation delays for the N semiconductor emitters are each $K_i$ times a clock time of the clock frequency. These semiconductor emitters are numbered by i, where $i \in [1; N]_N$ for all $K_i \in N_0$. For one or more or all of the semiconductor emitters of the group in question it applies that $K_i \neq 0$.

According to at least one embodiment, the following applies to all $K_i$: $0 \leq K_i \leq 12$. Preferably, for at least some or even for all of the $K_i$ it applies: $2 \leq K_i \leq 8$.

Such activation delays, which correspond to the clock time or a multiple of the clock time, are also referred to as dummy clocks. In other words, the dummy clocks correspond to the number of clock times that lasts for the activation delay. For applications with high multiplex rates, for example, the light emission behavior of the light emission from blue-emitting chips is delayed without further measures so long as it comes to a reddish image content in the case of dark image contents, that is to say at a particularly low forward current, and at long starting times. This means that the blue-emitting chips have comparatively large intrinsic activation times.

In addition to an influence of the material system and the target wavelengths of the semiconductor chips, there are still manufacturing distributions of the individual chip capacities. These are usually statistically distributed and cannot be compensated for by a standardized dummy clock approach, without more accurate knowledge of the individual capacitances of the semiconductor emitters being present. If dummy clocks are used in other methods, then, in the control case, a correction takes place at best for a specific operating field of a control chip with a specific channel number and/or the same number of dummy clocks are set per emission color. Due to cost savings, such a dummy clock setting can also be uniformly adjusted for the entire display device.

In this way, however, color shifts can only be corrected to a limited extent. In contrast, in the control method described here, the activation delays are determined individually for the individual semiconductor emitters, so that different dummy clocks can also be set within the semiconductor chips of a specific emission color.

The chip-fine compensation is carried out in particular automatically with the control method described here, for example, by measuring a rise time or a decay time in a voltage profile.

According to at least one embodiment, the semiconductor emitters are energized with a target current strength after a switch-on phase. That is to say, after the switch-on phase, the applied current intensity can be constant for the individual semiconductor emitters. It is possible for the semiconductor emitters to be fed from a constant current source. The target current intensity for all semiconductor emitters of a specific emission color is preferably nominally the same, that is to say within operational fluctuations.

According to at least one embodiment, during the switch-on phase, the target current intensity for the individual semiconductor emitters is increased or decreased temporarily or permanently by the associated turn-on current change. In other words, unlike in the normal operation of semiconductor emitters at a constant current source, the desired current intensity in the switch-on phase is changed in a targeted manner. In this way, different charging currents of capacitances associated with the semiconductor emitters can be compensated.

According to at least one embodiment, the turn-on current change associated with the individual semiconductor emitters is used per start-up cycle during the switch-on phase in each case only in at most two cycle times or also only in at most one of the cycle times. This means that the turn-on current change is used only comparatively briefly and in particular not over the entire switch-on phase.

According to at least one embodiment, during the switch-on phase at least some of the semiconductor emitters are operated per start-up cycle with cycle times having an activation current change and with cycle times without an activation current change. Hence, the turn-on current change is limited in a targeted manner to specific cycle times of the start-up cycle.

Alternatively, it is possible for the turn-on current change to be present across the entire switch-on phase. That is to say, during the switch-on phase on the one hand and during the subsequent normal operation, in each case a certain, constant current intensity is present.

According to at least one embodiment, the turn-on current change for the individual semiconductor emitters is at most 50% of the target current intensity. Alternatively or additionally, the turn-on current change is at least 15% of the target current intensity.

According to at least one embodiment, the different intrinsic activation times within the at least one group with the N semiconductor emitters are to at least 40% or 60% or 80% or completely due to different capacitances of the semiconductor emitters. These semiconductor emitters of the aforementioned group preferably have the same emission color and/or emission wavelength within the scope of manufacturing tolerances.

According to at least one embodiment, in step B) the activation delays and/or the turn-on current changes for the individual semiconductor emitters are determined by a measurement of a time-voltage curve at a current supply of the respective semiconductor emitter. In this case, the activation delays and/or the turn-on current changes are determined, in particular, by determining a rise time or a decay time of the time-voltage curve.

The rise time or the decay time is, for example, a so-called $\tau 10$-$\pi 90$ time, that is to say a period of time within which the voltage drops or rises from 10% to 90%, based on a starting point and to an end point of the voltage change. Alternatively, the rise time or the decay time may be a time constant during which an increase or decay occurs to an e-fold or to 1/e, where $e \approx 2.71828$.

According to at least one embodiment, the semiconductor emitters are operated with a precharge function. That is to say, a precharge voltage, which is preferably greater than a forward voltage of the associated semiconductor emitter, is present at a current supply before the relevant semiconductor emitter is switched on. By means of an adapted precharging function, also referred to as precharge, different capacities of the semiconductor emitters can be compensated efficiently and the switch-on phase can be shortened overall. The precharge function is realized in particular in a constant current source for the relevant semiconductor emitters.

According to at least one embodiment, some or all of the semiconductor emitters associated with the various activation delays and/or turn-on current changes are configured to emit light of the same color, for example, to generate red light. In particular, these semiconductor emitters are structurally identical within the scope of manufacturing tolerances. Thus, a fluctuation range of the semiconductor emitters due to the production thereof is compensated for via the activation delays and/or via the turn-on current changes.

In addition, a display device is specified. The display device is operated by a control method as described in connection with one or more of the above-mentioned embodiments. Features of the display device are therefore also disclosed for the control method and vice versa.

In at least one embodiment, the display device comprises a plurality of the semiconductor emitters which are configured for light emission and which have the different intrinsic activation times. Furthermore, the control device comprises one or more control chips, wherein the at least one control chip is designed to determine the intrinsic activation times of the individual semiconductor emitters and to determine and store in each case an activation delay and/or a turn-on current change for each of the individual semiconductor emitters. Furthermore, a current source, in particular a constant current source, is present, which is configured to energize the individual semiconductor emitters according to the previously determined activation delay and/or turn-on current changes, so that the semiconductor emitters in the display mode of the display device have equally long starting times and thus a light emission of the semiconductor emitters begins at the same time.

According to at least one embodiment, the display device comprises a plurality of the control chips and a plurality of the current sources, wherein an unambiguous assignment can be present between the control chips and the current sources.

According to at least one embodiment, the display device comprises at least one clock generator. The clock frequency is predetermined by the clock generator.

According to at least one embodiment, exactly one of the control chips for driving the respective semiconductor emitters is present per group of semiconductor emitters. The semiconductor emitters within each of the groups preferably each have the same emission color. The groups preferably include at least four or eight or 16 and/or at most 128 or 64 or 32 of the semiconductor emitters.

According to at least one embodiment, the activation delays and/or the turn-on current changes for the semiconductor emitters connected to the relevant control chip are stored in the control chips. This means that the activation delays and/or the turn-on current changes are stored locally and/or close to the relevant semiconductor emitters. Control paths to the relevant semiconductor emitters are preferably designed to be as short as possible.

According to at least one embodiment, the current sources are each configured to be controlled by the associated control chip for energizing the relevant semiconductor emitter or the relevant semiconductor emitters. For example, the one current source per control chip is configured for the sequential energization of all associated semiconductor emitters.

According to at least one embodiment, the display device is an RGB display. That is to say, red-emitting semiconductor emitters, green-emitting semiconductor emitters and blue-emitting semiconductor emitters are present in combination with one another, wherein the semiconductor emitters emitting in different colors are preferably based on different semiconductor material systems.

A control method described here and a display device described here are explained in more detail below with reference to the drawing on the basis of exemplary embodiments. Identical reference signs indicate identical elements in the individual figures. In this case, however, no true-to-scale references are shown; rather, individual elements can be shown in an exaggerated size for better understanding.

Figure 2:
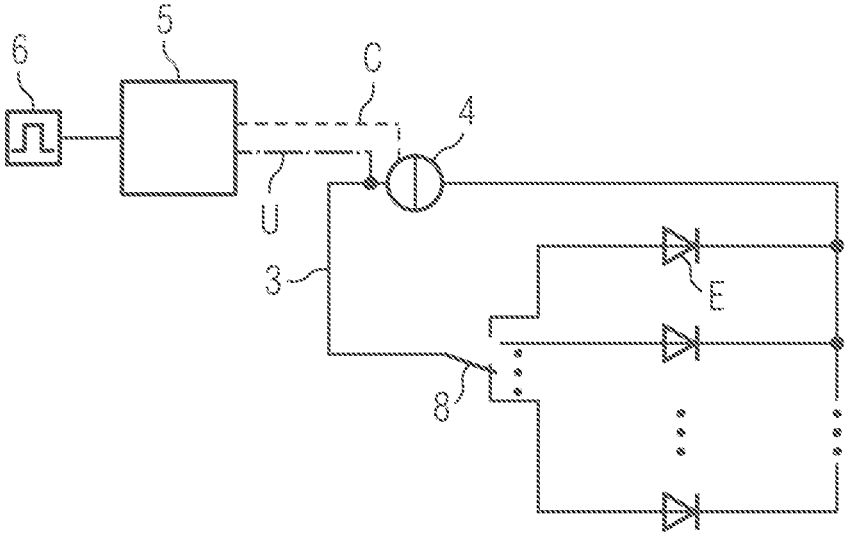
Figure 7:
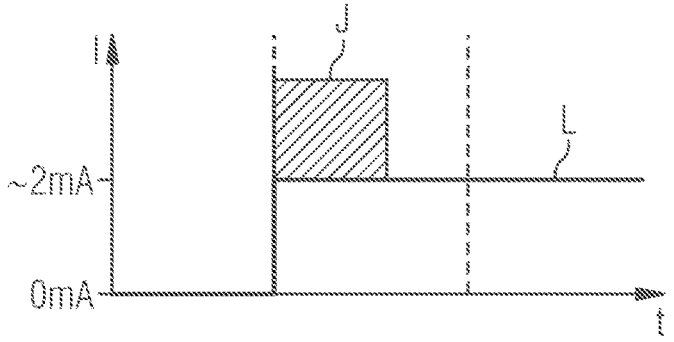
Figure 8:
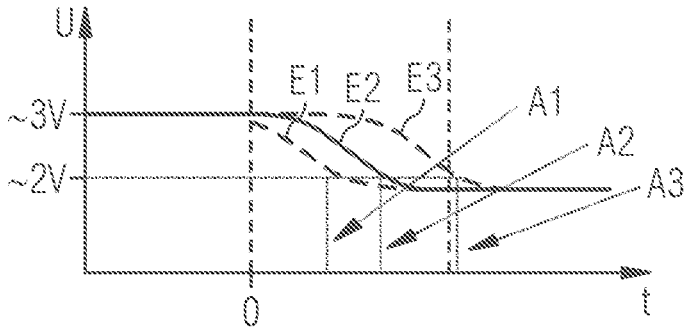
Figure 9:
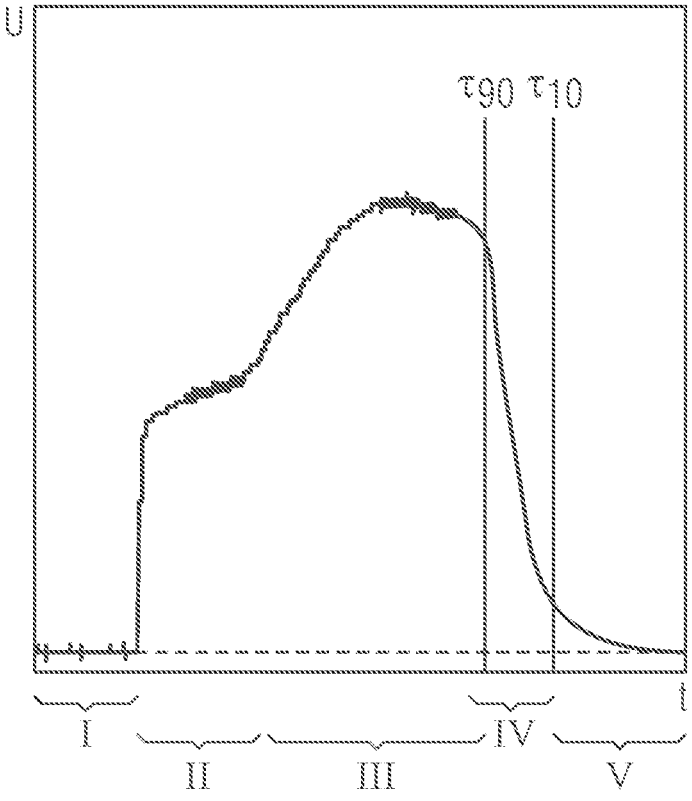

In the figures:

FIG. 1 shows a schematic plan view of an exemplary embodiment of a display device described here, FIG. 2 shows a schematic circuit diagram for operating semiconductor emitters for methods and display devices described here, FIGS. 3 to 8 show schematic representations of time profiles of voltages or light emissions or currents for semiconductor emitters for control methods described here and for display devices described here, and FIG. 9 shows a schematic time-voltage curve for determining a decay time for determining activation delays and/or turn-on current changes for control methods described here and for display devices described here.

FIG. 1 illustrates an exemplary embodiment of a display device 1. The display device 1 comprises a plurality of semiconductor emitters E which are configured for light emission. The semiconductor emitters E are each connected to a control chip 5 in groups of, for example, eight semiconductor emitters E. The control chip 5 is in particular an integrated circuit, IC for short. The semiconductor emitters E can be electrically controlled individually via the respective control chip 5.

The control chips 5 are preferably jointly connected to a control unit 2. The control unit 2 is in particular configured to receive control signals or signals for images to be displayed. This means that the entire image to be displayed by the display device 1 can be detected from an input signal via the control unit 2 and converted into control signals for the individual control chips 5. The control unit 2 preferably comprises a clock generator 6 which outputs a clock frequency. The clock frequency is preferably in the megahertz range.

All semiconductor emitters E, which are connected to a specific control chip 5, are preferably structurally identical within the scope of manufacturing tolerances and are designed to emit light of a specific color. That is to say, pixels 7 for colored emission extend over a plurality of the strings and thus over a plurality of control chips 5.

FIG. 2 shows an example of a circuit around a single control chip 5. A current source 4 is preferably controlled by the control chip 5 via a control signal C. The current source 4 can interact with a switching unit 8, for example, composed of a plurality of transistors. A plurality of the light-emitting semiconductor emitters E can be controlled sequentially via the switching unit 8 and via the current source 4.

The control chip 5 receives, in addition to control signals, not shown, from the control unit 2 preferably a signal from the clock generator 6. Furthermore, preferably a line exists from the control chip 5 for measuring a voltage U at an output of the current source 4.

In contrast to the illustration of FIG. 2, it is also possible for the current source 4 and the control chip 5 to be integrated in a single component, such as a microcontroller. The lines for the voltage U and for the control signal C can thus be lines within a semiconductor chip.

Figure 3:
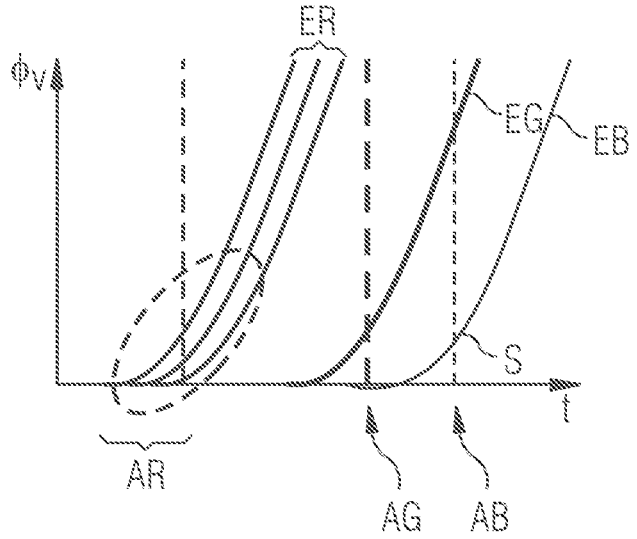

FIG. 3 shows a curve of a luminous flux $\Phi v$ as a function of time t. The curves for a semiconductor emitter EB for blue light, for a semiconductor emitter EG for green light and for a plurality of semiconductor emitters ER for red light are shown. It can be seen that the various semiconductor emitters EB, EG, ER have different intrinsic activation times AR, AG, AB. That is, a light emission of the various semiconductor emitters begins at different times. Thus, different starting times S are present for the respective light emission.

The differences in the activation times AR, AG, AB between different emission colors are relatively large. However, fluctuations of the intrinsic activation time AR also occur within, for example, the red-emitting semiconductor emitters. In particular, the distribution of the switching times AR between the different semiconductor emitters ER for red light is subject to statistical fluctuations.

Figure 4:
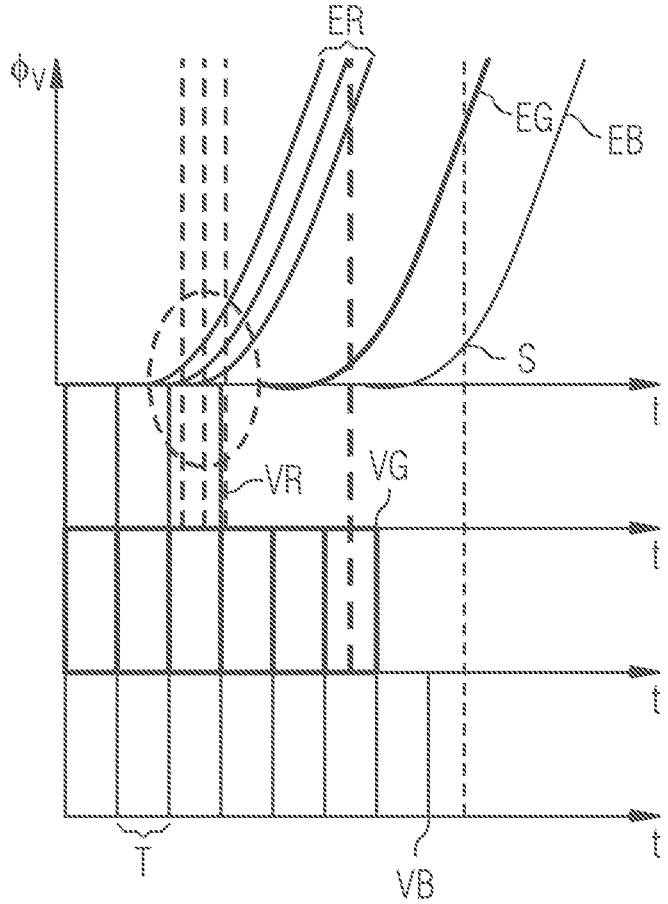

FIG. 4 illustrates a correction via different activation delays VB, VG, VR. In this case, control takes place at a clock frequency with cycle times T, wherein the cycle time T is an inverse of the clock frequency. In order to allow light emission of all semiconductor emitters EB, EG, ER at the same time, different numbers of cycle times T are specified as activation delay VB, VG, VR for the different types of semiconductor emitters.

Figure 5:
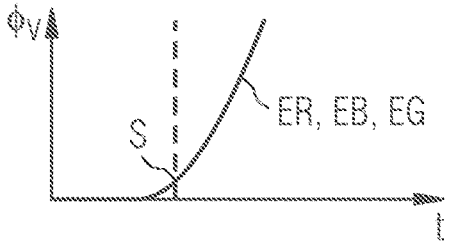

The result of this is shown in FIG. 5. Due to this compensation, a light emission of the semiconductor emitters begins approximately at the same starting time S.

As illustrated in FIG. 3, in particular for the red-emitting semiconductor emitters ER, however, different intrinsic activation times AR are present for the different emitters ER. This is explained in more detail in FIG. 6. It can be seen here that compensation only with regard to the actual starting times S via the activation delays V1, V2, V3 has still a comparatively great inaccuracy. This can be compensated by the fact that a turn-on current change J takes place, indicated schematically in FIG. 6 by a hatching. The turn-on current change J is, for example, a reduction of a current with respect to a target current strength L for a subsequent continuous operation of the relevant semiconductor emitter ER, in particular in the last cycle time T of the associated activation delay V1, V2, V3.

In contrast, FIG. 7 schematically illustrates that the turn-on current change J is an increase in the target current strength intensity L. In this case, a current I is plotted against time t in FIG. 7.

Figure 6:
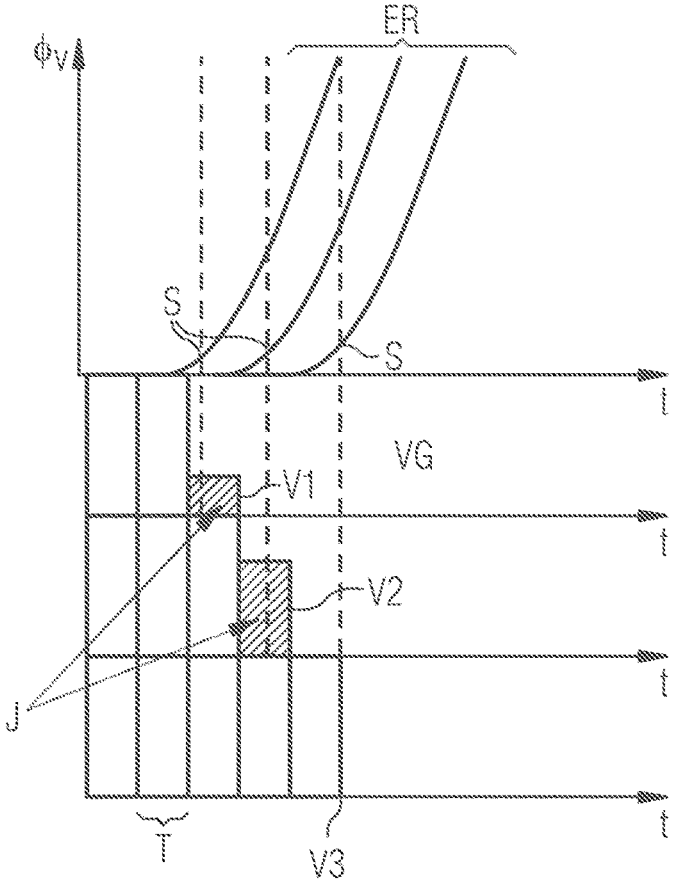

In FIGS. 6 and 7, variants are shown, according to which the turn-on current change J is a reduction or an increase in the target current strength L. Furthermore, it is illustrated that the turn-on current change J can be present over an entire switch-on phase or is limited to certain cycle times within a switch-on phase. These two possibilities, that is to say, turn-on current increase and turn-on current reduction on the one hand, and applying the turn-on current change J during an entire switch-on phase or only during a part of the switch-on phase on the other hand, can be combined with one another as desired, so that the combinations not shown in FIGS. 6 and 7 can also be present.

FIG. 8 shows a curve of a voltage U along time t. The voltage U is measured, in particular, at an output of the current source 4, which is in particular a constant current driver, to the semiconductor emitters E, as illustrated in FIG. 2. A switching-on of the various semiconductor emitters E1, E2, E3 takes place at the time t=0. It can be seen that different time profiles of the voltages for the respective semiconductor emitters E1, E2, E3 are present. The semiconductor emitters E1, E2, E3 correspond, in particular, to the semiconductor emitters ER from FIG. 6 and are therefore nominally identical within the scope of manufacturing tolerances and are designed to generate red light, but nevertheless have different activation times A1, A2, A3.

The different intrinsic activation times A1, A2, A3 can be determined via the different profiles of the voltages of the semiconductor emitters E1, E2, E3. These activation times A1, A2, A3 are in particular accompanied by different capacitances of the associated semiconductor emitters E1, E2, E3.

By this determination and storage of the different activation times A1, A2, A3, the turn-on current changes J and the activation delays V can be determined, which are necessary in order to start the light emission of the relevant semiconductor emitters E1, E2, E3 at the same time. A corresponding control of the semiconductor emitters E1, E2, E3 can then take place via the respectively associated control chip 5.

An exemplary profile of the voltage U at the output of the constant current driver 4 is shown in FIG. 9. For example, the display device 1 is supplied with a supply voltage of 5 V and the driver output is at a voltage of 2 V if the associated semiconductor emitter is connected. Thus, 3 V drops across the semiconductor emitter, and the forward voltage is achieved and current begins to flow. This is shown in the time domain I.

If the driver is to turn off the associated semiconductor emitter, the driver output is pulled to a higher potential and the forward voltage of the semiconductor emitter is thus reduced until no more current can flow. This is shown at the beginning of the time domain II.

A pre-charging function which can suppress interfering effects such as so-called lower ghosting is then optionally activated in the time domain III. After these steps I to III, a cycle is completed with respect to turning off and the next cycle, for example, operating the next line in the display device, can begin. For this purpose, the potential of the output of the driver must fall back to 2 V. This dropping of the voltage U is dependent on a capacitance of the operated semiconductor emitter.

If a semiconductor emitter with a comparatively high capacity is to be operated here, the corresponding charging lasts correspondingly longer with the same current. Thus, different charging times result, which can be determined with a τ10-τ90 measurement, as a result of which conclusions can be drawn about the capacitance of the associated semiconductor emitter. A corresponding measurement of the decay time of the voltage U is illustrated in the time domain IV in FIG. 9. In the time domain V, the associated semiconductor emitter is switched on again and the time domain V then ends, not shown, subsequently with a time domain I. In FIG. 9, an entire cycle is thus illustrated.

In the course of the procedure as illustrated in FIG. 9, a value of the initial voltage is preferably stored in the control chip 5 and the switch-on phase is measured in the time domain IV in the case of sufficiently rapid scanning. The value of τ10-τ90 can be determined by comparing the voltage values determined therefrom. The value τ10-τ90 is, for example, between 0.5 μs and 1.5 μs, in particular averaged over all semiconductor emitters. The higher this value, the longer the activation delay V to be maintained must be and/or the greater the charging current required for this, and thus the turn-on current change J. This charging current does not necessarily correspond to the target current strength L, that is to say, the display operating current, but is preferably individually adapted.

In addition, discretization errors which occur at discrete activation delays V at intervals corresponding to the cycle time T and with the target current strength L can be minimized by the analog signal of the turn-on current change, as illustrated in connection with FIG. 6. In addition, it is possible to react to changing operating modes by a regular measurement, so that an always optimal compensation can be achieved over the entire service life of the display device.

This measurement, as illustrated in connection with FIG. 9, is preferably carried out for each of the semiconductor emitters, and the measurement result is stored for each of the semiconductor emitters, so that an individual energization matched to each individual semiconductor emitter can be carried out.

For example, the capacitances of the semiconductor emitters are, at an edge length of 230 μm, in the case of square thin-film LED chips at 10 pF for emission in the red spectral range, at 30 pF for emission in the green spectral range and at 40 pF for emission in the blue spectral range. This applies in particular to differential capacitances at 0 V. These values can apply, for example, with a tolerance of at most a factor 5 or of at most a factor 2 in all exemplary embodiments.

A fluctuation of the capacitance between different nominally structurally identical semiconductor emitters is, for example, at most +/10% or +/20% and/or at least +/2% or +/5%.

In the case of semiconductor emitters with a sapphire substrate, the fluctuation of the capacitance can also be up to +/−50%.

Typical cycle times T are 30 ns, at a clock frequency of 33 MHz. The cycle time may also be significantly smaller and may be at most 10 ns or 5 ns, for example, at a clock frequency of up to 240 MHz.

Typical values for the activation delay are 1 μs to 1.5 μs, in particular between 0.2 μs and 2 μs.

The semiconductor emitters are addressed, for example, up to 25,000 times during the representation of a frame.

The capacitances C of the semiconductor emitters are preferably completely charged after at most 15 or after at most 10 cycle times.

Based on, for example, an activation delay of a few μs and a clock frequency of up to 240 MHz, corresponding to a cycle time of 3.75 ns, with the method described here, a sufficiently accurate temporal resolution and correction of the activation delay is possible, in particular on the basis of the course of the voltage, as illustrated by way of example in FIG. 9.

The invention described here is not limited by the description on the basis of the exemplary embodiments. Rather, the invention encompasses any novel feature and any combination of features, which in particular includes any combination of features in the claims, even if this feature or this combination itself is not explicitly specified in the patent claims or exemplary embodiments.

LIST OF REFERENCE SIGNS

1 display device
2 control unit
3 power supply
4 current source
5 control chip
6 clock generator
7 image point
8 switching unit
A intrinsic activation time
B blue
C control signal
E light-emitting semiconductor emitter
G green
I current
J turn-on current change
L target current strength
R red
S starting time for light emission
t time
T cycle time
U voltage
V activation delay
Φv luminous flux
I . . . V time domains

The invention claimed is:

1. A control method for a display device, which comprises a plurality of light-emitting semiconductor emitters with different intrinsic activation times, wherein the method comprises:

A) determining the intrinsic activation times of the individual semiconductor emitters, B) determining and storing in each case an activation delay and/or a turn-on current change for each individual one of the semiconductor emitters, and C) energizing the individual semiconductor emitters according to the previously determined activation delay and/or turn-on current change, so that in a display mode of the display device the semiconductor emitters have equally long starting times for a light emission, wherein the display device has at least one group with N semiconductor emitters, the display device is controlled at a clock frequency, the individual activation delays for the N semiconductor emitters are $K_i$ times of a clock time of the clock frequency, and these semiconductor emitters are numbered with i, where $i \in [1; N]_N$ and all $K_i \in N_0$, and for at least one of the semiconductor emitters it applies that $K_i \neq 0$.

2. The control method according to claim 1, where for all $K_i$ it applies: $0 \leq K_i \leq 12$, and wherein for at least some of the $K_i$ it applies: $2 \leq K_i \leq 8$.

3. The control method according to claim 1, wherein the semiconductor emitters are energized with a target current intensity after a switch-on phase, and during the switch-on phase, the target current intensity for the individual semiconductor emitters is increased or decreased at least temporarily by the associated turn-on current change.

4. The control method according to claim 3, wherein the turn-on current change associated with the individual semiconductor emitters is present per turn-on cycle during the switch-on phase only in at most two cycle times.

5. The control method according to claim 4, wherein the turn-on current change belonging to the individual semiconductor emitters is present per turn-on cycle during the switch-on phase only in exactly one cycle time, and wherein at least some of the semiconductor emitters are operated per turn-on cycle during the switch-on phase with clock times with the turn-on current change and with clock times without the turn-on current change.

6. The control method according to claim 3, wherein the turn-on current changes are each at most 50% of the target current intensity.

7. The control method according to claim 1, wherein the activation delays of at least some of the semiconductor emitters are at least 0.2 μs and at most 2 μs.

8. The control method according to claim 1, wherein in step B) the activation delays and/or the turn-on current changes for the individual semiconductor emitters are determined by a measurement of a time-voltage curve at a power supply of the respective semiconductor emitter.

9. The control method according to claim 8, wherein the activation delays and/or the turn-on current changes in step B) are determined by a rise time or by a decay time of the time-voltage curve.

10. The control method according to claim 8, wherein the semiconductor emitters are operated with a precharge function such that a precharge voltage is present at the power supply before switching on the respective semiconductor emitter, which precharge voltage is greater than a forward voltage of said semiconductor emitter.

11. The control method according to claim 1, wherein at least some of the semiconductor emitters, to which the different activation delays and/or turn-on current changes are assigned, are configured to emit light of the same color.

12. The control method according to claim 1, wherein at least some of the semiconductor emitters, to which the different activation delays and/or turn-on current changes are assigned, are structurally identical within the scope of manufacturing tolerances.

13. A display device which is operated with a control method according to claim 1, comprising:

a plurality of semiconductor emitters, which are configured for light emission and which have intrinsic activation times, a control chip, which is configured to determine the intrinsic activation times of the individual semiconductor emitters and to determine and store in each case an activation delay and/or a turn-on current change for each individual one of the semiconductor emitters, and a current source, which is configured to energize the individual semiconductor emitters according to the previously determined activation delay and/or turn-on current change, such that the semiconductor emitters have equally long starting times in the display operation of the display device.

14. The display device according to claim 13, comprising a plurality of the control chips and a plurality of the current sources and further comprising a clock generator, wherein groups of at least four and of at most 64 of the semiconductor emitters of identical construction within the scope of the manufacturing tolerances are each controlled by exactly one of the control chips, the activation delays and/or the turn-on current changes for the semiconductor emitters connected to the respective control chip are stored in the control chips, the current sources are configured to be respectively controlled by the associated control chip for energizing the assigned semiconductor emitter, and the display device is an RGB display such that red, green and blue-emitting semiconductor emitters are present.

15. A control method for a display device, which comprises a plurality of light-emitting semiconductor emitters with different intrinsic activation times, wherein the method comprises:

A) determining the intrinsic activation times of the individual semiconductor emitters, B) determining and storing in each case an activation delay and/or a turn-on current change for each individual one of the semiconductor emitters, and C) energizing the individual semiconductor emitters according to the previously determined activation delay and/or turn-on current change, so that in a display mode of the display device the semiconductor emitters have equally long starting times for a light emission, wherein the semiconductor emitters are energized with a target current intensity after a switch-on phase, wherein during the switch-on phase, the target current intensity for the individual semiconductor emitters is increased or decreased at least temporarily by the associated turn-on current change, and wherein the turn-on current changes are each at most 50% of the target current intensity.

16. A control method for a display device, which comprises a plurality of light-emitting semiconductor emitters with different intrinsic activation times, wherein the method comprises:

A) determining the intrinsic activation times of the individual semiconductor emitters, B) determining and storing in each case an activation delay and/or a turn-on current change for each individual one of the semiconductor emitters, and C) energizing the individual semiconductor emitters according to the previously determined activation delay and/or turn-on current change, so that in a display mode of the display device the semiconductor emitters have equally long starting times for a light emission, wherein in step B) the activation delays and/or the turn-on current changes for the individual semiconductor emitters are determined by a measurement of a time-voltage curve at a power supply of the respective semiconductor emitter, and wherein the semiconductor emitters are operated with a precharge function such that a precharge voltage is present at the power supply before switching on the respective semiconductor emitter, which precharge voltage is greater than a forward voltage of said semiconductor emitter.

* * * * *